US007186043B2

(12) United States Patent
Keller

(10) Patent No.: US 7,186,043 B2
(45) Date of Patent: Mar. 6, 2007

(54) LINERLESS WEB UTILIZING APPARATUS AND METHODS HAVING DUAL FUNCTION STRIPPER ELEMENT

(75) Inventor: Thomas Patrick Keller, Centerville, OH (US)

(73) Assignee: Paxar Americas, Inc., Miamisburg, OH (US)

( * ) Notice: Subject to any disclaimer, the term of this patent is extended or adjusted under 35 U.S.C. 154(b) by 45 days.

(21) Appl. No.: 10/821,212

(22) Filed: Apr. 8, 2004

(65) Prior Publication Data

US 2005/0226672 A1 Oct. 13, 2005

(51) Int. Cl.
*B41J 15/04* (2006.01)
*B41J 11/04* (2006.01)

(52) U.S. Cl. ..... 400/619; 400/662; 400/644; 226/5

(58) Field of Classification Search ..... 400/648, 400/656, 657, 659, 611, 644, 661.1, 662, 400/619; 492/30, 33; 271/307, 308, 311–313, 271/900; 346/132; 226/5
See application file for complete search history.

(56) References Cited

U.S. PATENT DOCUMENTS 1,151,737 A * 8/1915 Thomas ..... 82/173
2,188,456 A * 1/1940 Galber ..... 409/71
2,348,355 A * 5/1944 Miller ..... 226/186
3,196,720 A * 7/1965 Streckfus ..... 82/158
3,405,855 A * 10/1968 Daly et al. ..... 242/615.4
3,894,453 A * 7/1975 Kusters ..... 82/158
3,955,889 A * 5/1976 Ishiguro et al. ..... 399/399
3,985,049 A * 10/1976 Streckfus ..... 82/158
4,285,507 A * 8/1981 Marinoff ..... 271/3.17
4,451,169 A * 5/1984 Umezawa ..... 400/631
4,768,063 A * 8/1988 Kunishima et al. ..... 355/29
5,267,800 A 12/1993 Petteruti
5,368,291 A * 11/1994 MacNiel ..... 271/308
5,497,701 A 3/1996 Uland
5,560,293 A * 10/1996 Boreali et al. ..... 101/288
5,779,370 A * 7/1998 Schroeder et al. ..... 400/120.01
5,833,377 A 11/1998 Keller
6,276,269 B1 * 8/2001 Bravenec ..... 101/178
6,347,897 B2 * 2/2002 Huggins et al. ..... 400/621
6,527,888 B2 * 3/2003 Williams et al. ..... 156/64
6,585,437 B1 7/2003 Wiklof
2004/0067088 A1 4/2004 Kline

FOREIGN PATENT DOCUMENTS

JP 01258970 A * 10/1989
JP 11-221948 A * 8/1999

OTHER PUBLICATIONS

Linerless Addendum, Monarch Marking Systems, Inc., 1998 TC9835LAD Rev. AB Jun. 1999.
Linerless Addendum, Monarch Marking Systems, Inc., 1998.

* cited by examiner

*Primary Examiner*—Leslie J. Evanisko
(74) *Attorney, Agent, or Firm*—Joseph J. Grass

(57) ABSTRACT

There is disclosed a printer with an arrangement for assuring that a linerless tacky adhesive-backed web is reliably fed. The printer has stripper elements which terminate at tip portions which extend into the platen roll to initially cut grooves in the platen roll, and because the tip portions extend below the outer periphery of the platen roll into these grooves, the stripper elements continue to strip the web reliably from the platen roll during subsequent printing cycles.

24 Claims, 3 Drawing Sheets

LINERLESS WEB UTILIZING APPARATUS AND METHODS HAVING DUAL FUNCTION STRIPPER ELEMENT

BACKGROUND OF THE INVENTION

1. Field of the Invention

This invention relates to printers for handling webs including linerless webs having tacky adhesive, methods associated with the handling of such webs, rolls including platen rolls, and methods of making rolls.

2. Brief Description of the Prior Art

The following documents are made of record: U.S. Pat. Nos. 5,267,800; 5,497,701; 5,833,377; 6,585,437; U.S. patent application Ser. No. 10/266,060, filed Oct. 7, 2002; and Linerless Addendum, Monarch Marking Systems, Inc. 1998.

SUMMARY OF THE INVENTION

The present invention relates to improved method and apparatus to strip a tacky adhesive-backed web from a roll reliably.

It is a feature of the invention to provide an improved printer for handling linerless, tacky, adhesive-backed webs wherein the webs are reliably stripped from a roll.

It is a feature of the invention to provide an improved printer for printing on a linerless web backed by a tacky adhesive which has a thermal print head and an adhesive-resistant, elastomeric, rotatable platen roll with a web stripper having at least one tip portion to cut at least one circumferential groove in the outer surface of the platen roll upon rotation of the platen roll. Initially, the tip portion or portions are positioned to dig or locally press into the elastomer platen roll. Upon rotation of the platen roll, a circumferential groove or grooves are cut in the surface of the platen roll. From the very beginning, the stripper causes the web to be reliably stripped from the roll. Repeated rotation of the platen roll completes the formation of the groove or grooves as the elastomeric material is cut and/or abraded away. After the groove or grooves have been cut, the linerless web continues to be reliably stripped from the web.

It is apparent that the groove or grooves are no wider or deeper than the tip portions that penetrate into the elastomeric material below the outer surface. Indeed, the tip portions "write their own name" in the platen roll, and the grooves are perfectly aligned with the tip portions which formed the grooves.

It is a feature of the invention to provide a stripper with one or more tip portions or cutters which serve to help strip the tacky, adhesive-backed web from the roll and which also function to make the groove(s) in the roll.

It is a feature of the invention to provide an improved, low friction shelf for a linerless printer which is relatively wide but which is rigid enough to resist flexure during use so that a linerless tacky adhesive-backed web is incapable of bowing the shelf and following the platen roll around.

BRIEF DESCRIPTION OF THE DIAGRAMMATIC DRAWINGS

DETAILED DESCRIPTION OF THE PREFERRED EMBODIMENTS

Figure 1:
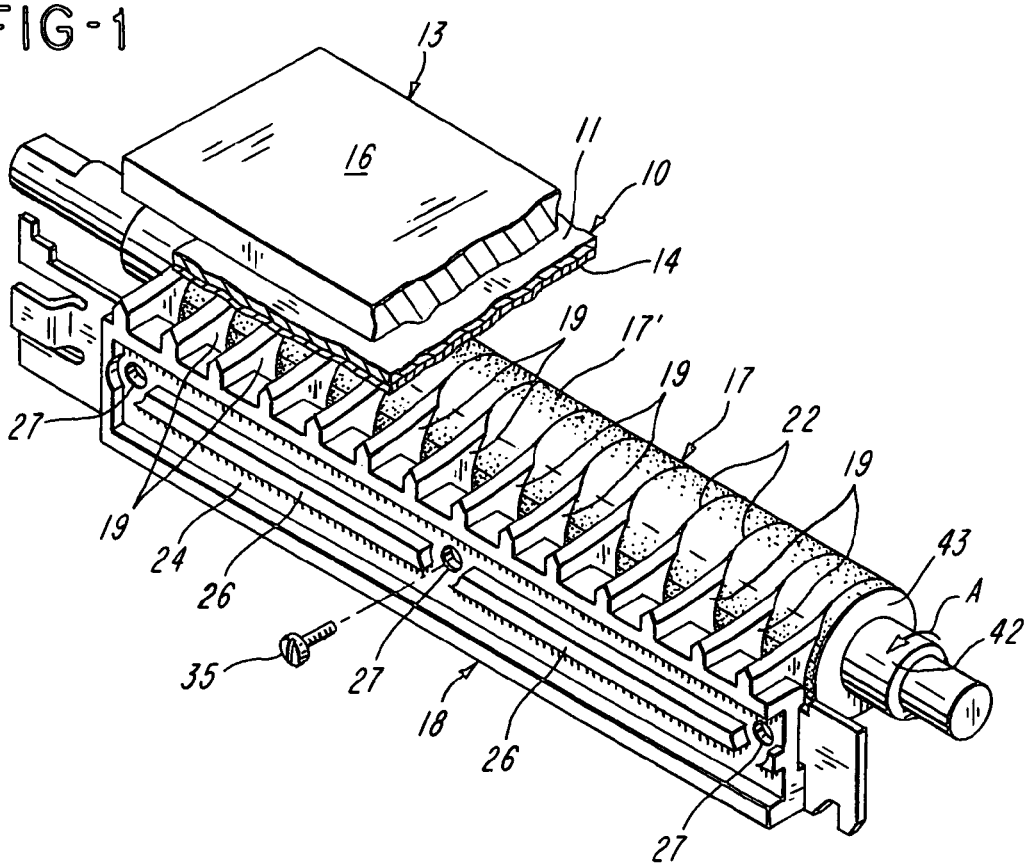
FIG. 1 is a perspective view of a printer for handling a linerless web backed with tacky adhesive.

With reference to FIG. 1, there is shown a portion of a printer generally indicated at 13 for printing on a linerless web generally indicated at 10 in printing cooperation with a print head 16 and a cooperating roll generally indicated at 17, in particular a platen roll. The web 10 can be either imperforate or it can be provided with longitudinally spaced transverse perforations (not shown) which define labels. The print head 16 is preferably a thermal print head but other types of print heads can be used. The platen roll 17 is composed of an elastomeric material such as silicone rubber and/or outer surface 17' of the platen roll 17 can be coated to be adhesive resistant. An elastomeric material is most preferred for a platen roll used with a thermal print head because it provides slightly yieldable support and counter-pressure to the print head 16, and it is resilient so as to be forgiving particularly in the event of slight misalignment of the print head 16 and the platen roll 17.

The web 10 has an upper face 11 with the usual coatings such as a thermal coating, an optional barrier coating and a silicone coating. The underside of the web 10 has a coating of adhesive 14 which can be uniform and continuous as shown, which is known as a "full gum" coating, but the coating of adhesive 14 can be patterned or a "part gum" coating which is useful in certain applications. The adhesive 14 is of the tacky type also known as "pressure sensitive adhesive" because it adheres to a surface when pressure is applied. Tacky adhesive is sticky or tacky without activation by heat, water or other medium.

Because rolls that are to be in contact with adhesive on one side of a linerless web are typically adhesive resistant, when such rolls become worn the adhesive on the linerless web adheres more tenaciously to the worn roll and the linerless web has a tendency to follow the roll around. The web may bunch up or buckle between the platen roll and a stripper even though the stripper is immediately adjacent to or touches the platen roll. When the linerless web adheres to the platen roll there is also a tendency of the buckled linerless web to push against the stripper or to bow the stripper to make an easier throat between the platen roll and the stripper through which the linerless web can pass.

Figure 4:
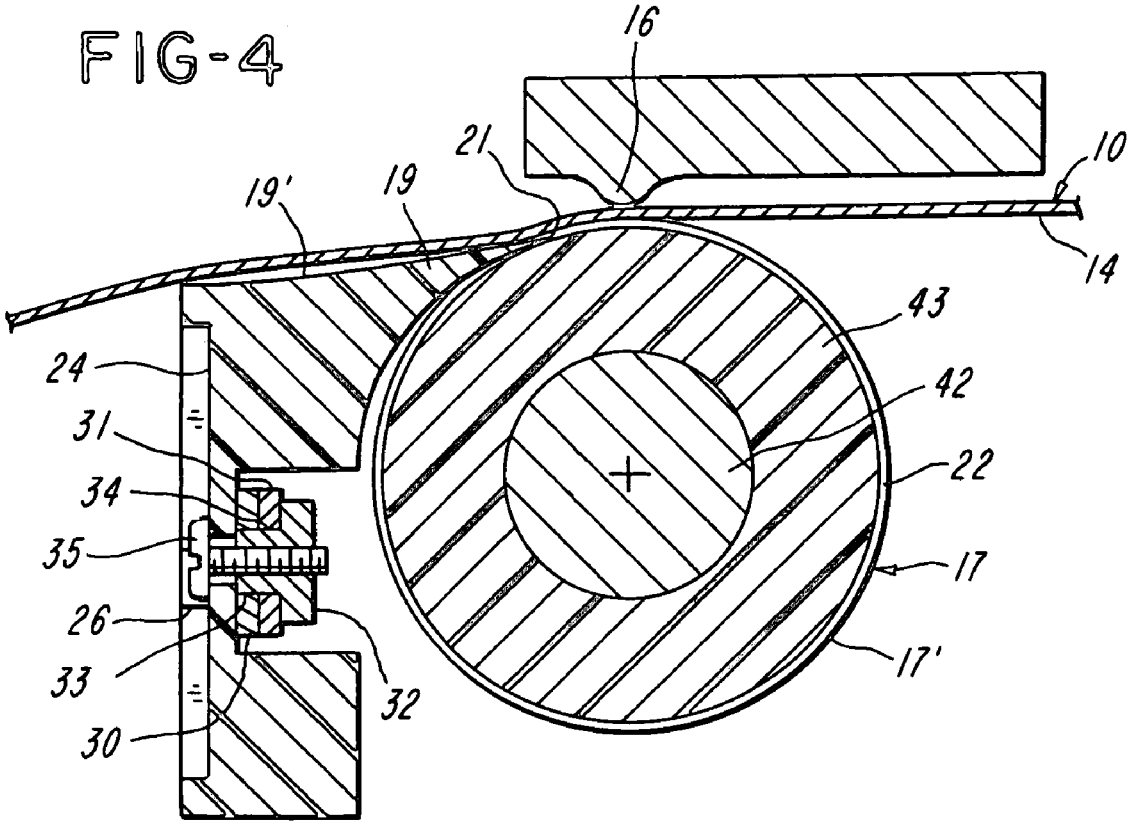
FIG. 4 is a sectional view taken through the stripper, the bar, the platen roll and the print head.
Figure 5:
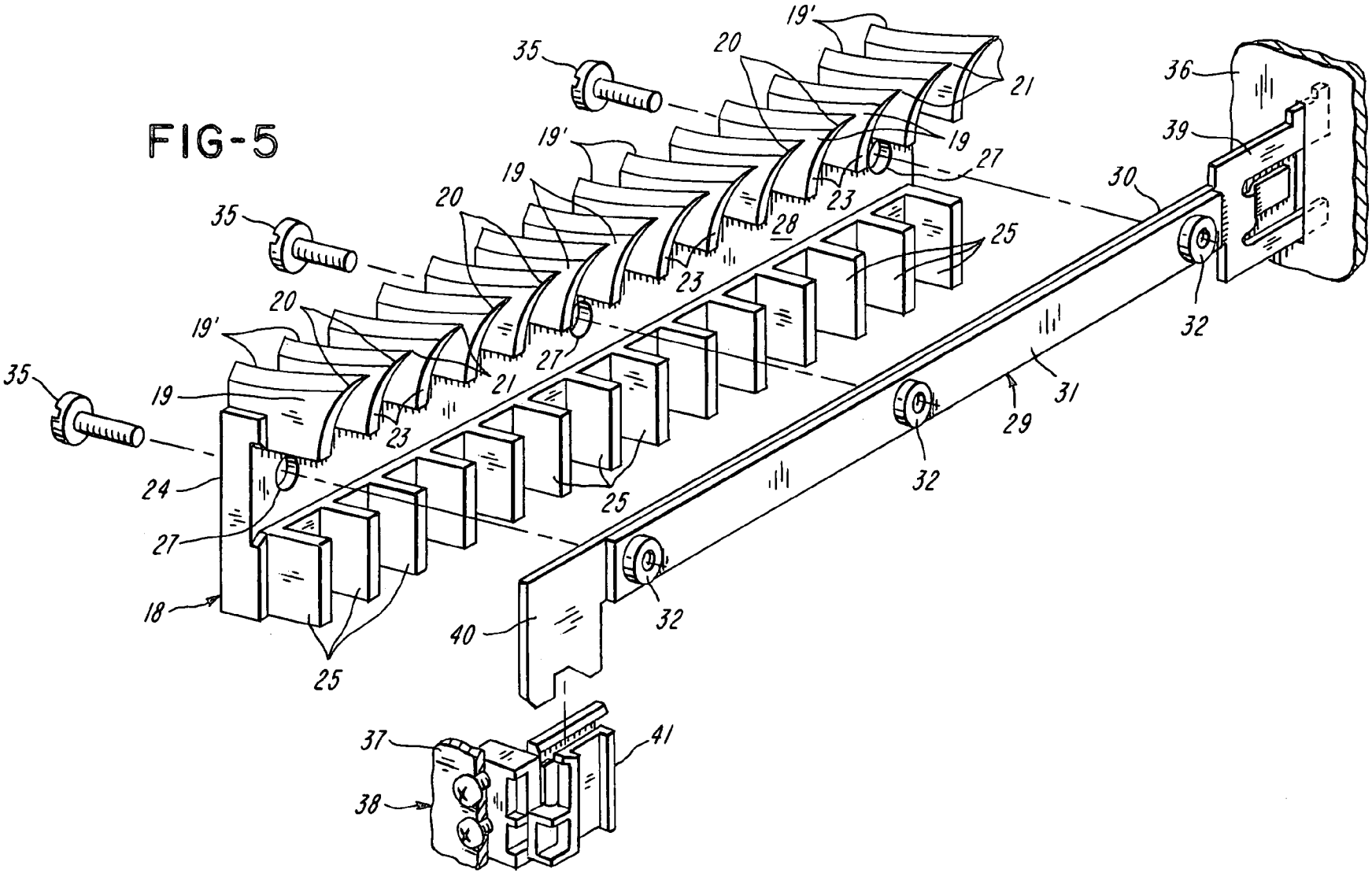
FIG. 5 is an exploded perspective view of a shelf with strippers or stripper elements terminating at tip portions or cutters and a bar for strengthening and mounting the shelf.

According to the invention, there is provided a support 18 with parallel support elements or members 19 which, as shown in FIG. 4, support the web following printing by the print head 16. The support elements 19 have tip portions 20. The tip portions 20 are preferably both sharp and pointed and terminate at laterally aligned points 21. The tip portions 20 are used to cut circumferential grooves 22 in the outer surface or periphery 17' of the platen roll 17, and thus the tip portions are cutters that cut the grooves 22. The tip portions 20 are those portions of the elements 19 that extend into the grooves 22. The tip portions 20 act initially as cutters. The elements 19 including their tip portions 20 act as strippers that help strip the web 10 from the platen roll 17. FIG. 4 shows that the elements 19 enter the grooves 22 essentially tangent to the surface of the outer surface 17', and more particularly, near the top of the outer surface 17'.

Figure 2:
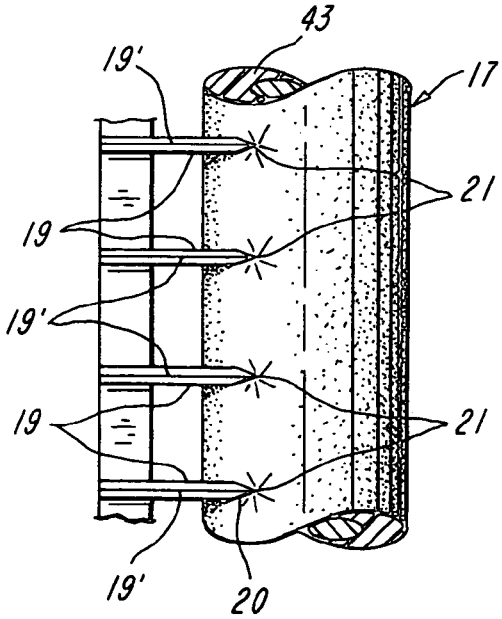
FIG. 2 is a fragmentary top plan view of the platen roll and the stripper elements initially dug or pressed into the platen roll.
Figure 3:
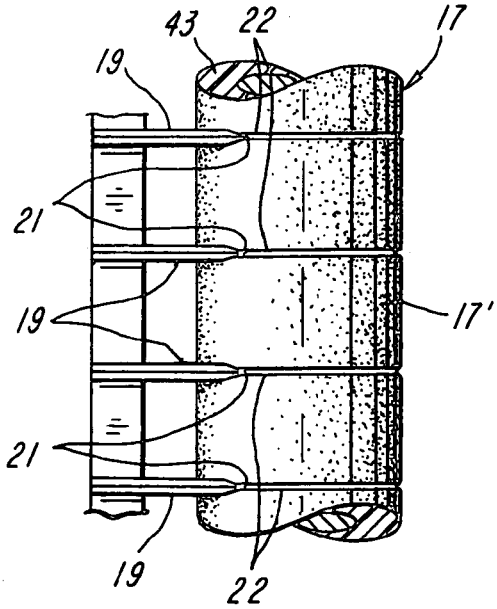
FIG. 3 is a fragmentary top plan view similar to FIG. 2 but showing the platen roll after the platen roll has been rotated to form the grooves in the platen roll.

Initially, the support 18 is positioned so that the points 21 depress and dig into the outer surface 17' of the platen roll 17 as illustrated in FIG. 2. Upon rotation of the platen roll 17, the tip portions or cutters 20 cut the grooves 22 as best shown in FIGS. 1 and 3. Once positioned as indicated above, the tip positions 20 can remain positioned in the grooves 22 throughout use of the printer 13. The tip portions 20 are slightly below the outer surface 17' of the roll 17. Because the tip portions 20 are below the outer surface 17' in the grooves 22, the linerless web 10 cannot go between the roll 17 and the element 19. Yet the grooves 22 are small enough so that the grooves 22 do not degrade the print quality. The grooves 22 are narrow enough and the web 10 is thick enough so that the web 10 remains well supported, and there is no tendency of the web 10 to take on an undulating configuration. It is preferred that the grooves 22 are of equal width and depth. The grooves 22 are no wider than the tip portions 20. There is no clearance between the sides of the tip portions 20 and the grooves 22, and there is no clearance between the tips 21 and the bottoms of the grooves 22. Once the tip portions are positioned to cut the grooves 22, they are in perfect alignment with the grooves formed by the tip portions 22, and there is therefore no need to adjust or reposition the stripper 18 with respect to the roll 17. By way of example, not limitation, the grooves are most preferably about 0.125 mm wide and about 0.125 mm deep. A typical web 10 is about 0.1 mm thick. The stripper elements 19 are blades or are blade-like in construction. The upper configuration of each element 19 is preferably inverted V-shaped as shown and terminates in a longitudinally extending linear or straight line-shaped edge as indicated at 19'. The elements 19 terminate at the points 21. The sides 23 of the elements 19 that face the platen roll 17 are arcuate and terminate at the points 21. The elements 19 are preferably equally spaced. The adhesive 14 of the web 10 contacts the edges 19' and the web 10 is accordingly supported by the edges 19' which exert only minimal drag on the web 10 as the web 10 advances.

The elements 19 are molded integrally with a bar portion 24 having ribs 25. The side of the bar portion 24 opposite the ribs 25 has spaced ribs 26. The bar portion 24 has three laterally spaced, oversize through-holes 27. The support or stripper 18 has a groove 28 disposed between the elements 19 and the ribs 25. A rigid metal bar generally indicated at 29 is received in the groove 28. The bar 29 is a composite comprised of a bar member 30 and a bar member 31 welded to the bar member 30. Internally threaded fasteners 32 pass through and are secured in aligned holes 33 and 34 in the bar members 30 and 31. Screws 35 pass through the holes 27 and are threaded into the threaded fasteners 32. The bar portion 24 and the composite bar 29 are clamped together by the head of the screw 35 and the fastener 32. Because of the clearances between the groove 28 and the bar 29 and between the holes 27 and the screws 35, the stripper 18 can be precisely positioned or adjusted manually so that the tip portions 20 penetrate or dig into the outer surface 17' to the desired depth. While the one-piece molded stripper 18 is rigid, the bar 29 adds rigidity and thus helps to maintain the tip portions 20 positioned in the grooves 22. As shown, the bar 29 is mounted in frame plates 36 and 37 of the printer frame 38. End portion 39 of the bar 29 hooks into the frame plate 36, and end portion 40 snaps into a clip 41 screwed to the frame plate 37. Further aspects of the printer 13 are shown in U.S. Pat. No. 5,833,377 incorporated herein by reference. The frame plates 36 and 37 in the present application correspond to walls 126 and 127 in U.S. Pat. No. 5,833,377.

The platen roll 17 is preferably comprised of a metal shaft 42 on which an elastomeric sleeve 43 is secured. The shaft is 42 preferably driven as illustrated in U.S. Pat. No. 5,833,377 while the thermal print head 16 prints in the web 10. As the platen roll 17 rotates, the web 10 is stripped from the roll 17 by the stripper elements 19, and the printed, stripped web 10 passes over the elements 19 with the adhesive 14 in contact with upper edges 19' of the elements 19. As shown in FIG. 4, the web 10 preferably follows a slightly downward trajectory as it is stripped from the platen roll 17 and is supported by elements 19.

The tip portions or cutters 20 cut the circumferential grooves by wearing away quite narrow circumferential zones of the outer portion of the sleeve 43 with relatively few rotations of the roll 17.

While the invention is applied to a platen roll 17 it is also useful when stripping adhesive-backed webs for various rolls other than platen rolls.

By way of example, not limitation, for a web which is about 102 mm wide, it is most preferred to use 14 stripper elements, however a greater or lesser number can be used. It is also within the spirit of the invention to have less than all the elements 19 extend into the grooves 22.

While the stripper 18 is stiffened or strengthened by the bar 29, the stripper 18 could be made stronger by making it from thicker plastics material and suitably mounting it to the frame plates 36 and 37. While the stripper 18 is preferably of one-piece molded plastics construction, the stripper 18 can be made in multiple parts.

The preferred illustrated shape of the tip portion 20 is such that if the platen roll 17 is to be rotated in the reverse direction from that shown by arrow A in FIG. 1 to bring the web 10 to the top-of-form position, no harm will come to the platen roll 17.

While the invention is particularly useful for use with linerless, tacky adhesive-backed, printable webs, the method and While the invention is particularly useful for use with linerless, tacky adhesive-backed, printable webs, the method and apparatus of the invention can also be used with adhesive webs having siliconized release liners.

Other embodiments and modifications of the invention will suggest themselves to those skilled in the art, and all such of these as come within the spirit of this invention are included within its scope as best defined by the appended claims.

The invention claimed is:

1. Method, comprising: providing an adhesive-resistant, elastomeric, rotatable platen roll for a printer, providing a web stripper having at least one tip portion positioned to cut at least one circumferential groove in the outer surface of the platen roll and to facilitate stripping of a web from the platen roll, and rotating the platen roll to cut the groove(s).

2. Method as defined in claim 1, including providing a thermal print head cooperable with the platen roll, providing the web positioned between and in contact with the print head and the platen roll, and the web moves in contact with the rotating platen roll.

3. Method as defined in claim 1, wherein the tip portion is sharp.

4. Method as defined in claim 1, wherein the tip portion is pointed.

5. Method as defined in claim 1, including providing a thermal print head cooperable with the platen roll, providing the web positioned between and in contact with the print head and the platen roll, wherein the web has a coating of tacky adhesive in contact with the platen roll, and printing on the web while the web moves and while the tip portion (s) cuts (or cut) the groove(s) in the rotating platen roll.

6. Method as defined in claim 1, including providing a thermal print head cooperable with the platen roll, and printing on the web positioned between and in contact with the print head and the platen roll after the groove(s) has (or have) been cut, and wherein the web has a coating of tacky adhesive contacting the platen roll.

7. Method as defined in claim 1, including providing a linerless web having a printable face side and an underside with a tacky adhesive positioned with the print head cooperable with the printable face side and the platen roll in contact with the adhesive, and printing on the web after the groove(s) has (have) been cut.

8. Method defined in claim 1, wherein the groove(s) is (are) small enough so as not to degrade print quality when printing on a linerless web having tacky adhesive in contact with the platen roll.

9. Method, comprising: providing an adhesive-resistant, elastomeric, rotatable platen roll for a printer, providing a web stripper having at least one tip portion, and positioning the stripper with the tip portion (s) digging into or locally depressing the outer surface of the platen roll so that upon rotation of the platen roll each tip portion will cut a circumferential groove in the outer surface of the platen roll and will facilitate stripping of a web from the platen roll.

10. Method as defined in claim 9, wherein each groove is no wider than the respective tip portion.

11. Method as defined in claim 9, wherein there are a plurality of grooves and the grooves are essentially the same size.

12. Method defined in claim 9, wherein the groove(s) is (are) small enough so as not to degrade print quality when printing on a linerless web having tacky adhesive in contact with the platen roll.

13. Method, comprising: providing an adhesive-resistant, elastomeric roll for contacting adhesive on a linerless web, providing a web stripper having at least one tip portion positioned to cut at least one circumferential groove in the outer surface of the roll and to facilitate stripping of the web from the roll, and rotating the roll to cut the groove(s).

14. Method as defined in claim 13, including printing on the web while the roll is rotating and while the stripper tip portion(s) is (are) in the groove(s).

15. Method as defined in claim 13, wherein the tip portion(s) remain in the groove(s) during subsequent rotation of the roll.

16. Method defined in claim 13, wherein the groove(s) is (are) small enough so as not to degrade print quality when printing on a linerless web having tacky adhesive in contact with the roll.

17. Method, comprising: providing an adhesive-resistant, elastomeric roll for contacting adhesive on a linerless web, providing a web stripper having at least one tip portion, positioning the stripper with the tip portion(s) digging into or locally depressing the outer surface of the roll so that upon rotation of the roll each tip portion will cut a circumferential groove in the outer surface of the roll and will facilitate stripping of the web from the roll.

18. In or for a printer: a print head and a cooperable platen roll for printing on a linerless web having a printable face side and an underside with a tacky adhesive, the platen roll having an adhesive-resistant elastomeric outer surface, and a web stripper with a tip portion positioned to cut at least one circumferential groove in the outer surface of the platen roll and to facilitate stripping of the web from the platen roll.

19. In or for a printer: a print head and a cooperable platen roll for printing on a web of linerless label material with a printable face side and an underside with a tacky adhesive, the platen roll having an adhesive-resistant elastomeric outer surface, and a web stripper having at least one portion positioned to cut at least one circumferential groove in the outer surface of the platen roll and to facilitate stripping of the web from the platen roll.

20. In or for a printer as defined in claim 19, wherein the groove(s) is (are) small enough so as not to degrade print quality when printing on the web of linerless label material having the tacky adhesive in contact with the platen roll.

21. In or for a printer as defined in claim 19, and using the print head and platen roll to print on a web of linerless label material while the tip portion(s) is (are) in the groove(s).

22. In combination: a roll having an adhesive-resistant, elastomeric outer surface for contacting a tacky adhesive on a linerless web, and a stripper with a tip portion positioned to cut at least one circumferential groove in the outer surface of the roll and to facilitate stripping of the web from the roll.

23. In combination: a roll having an adhesive-resistant, elastomeric outer surface for contacting a tacky adhesive on a linerless web, and a stripper having at least one tip portion locally dug or pressed into the outer surface of the roll so that upon rotation of the roll the tip portion(s) will cut a groove or grooves into the roll and will facilitate stripping of the web from the roll.

24. In combination: a printer including a frame, a laterally extending platen roll, a print head cooperable with the platen roll to print on a web, a web stripper constructed of plastics material, a rigid bar having end portions secured to the frame, the web stripper being adjustably secured to the bar to enable the web stripper to be brought into and maintained in stripping relationship to the platen roll, and wherein the web stripper includes cutters positioned to cut grooves in the outer surface of the platen roll and to assist in stripping the web from the platen roll.

* * * * *